United States Patent [19]

Kreuz et al.

[11] 4,275,853

[45] Jun. 30, 1981

[54] CUTTING TOOL

[76] Inventors: Ulrich H. Kreuz, Hölderlinweg 18, 7141 Erdmannhausen; Kurz H. Wendel, Talstr. 45, 7250 Leonberg 5, both of Fed. Rep. of Germany

[21] Appl. No.: 54,789

[22] Filed: Jul. 5, 1979

[30] Foreign Application Priority Data

Jul. 6, 1978 [DE] Fed. Rep. of Germany ..... 2829732

[51] Int. Cl.[3] ..... B02C 1/10; B27G 13/00; B26D 1/12

[52] U.S. Cl. ..... 241/294; 144/230; 407/33; 407/50

[58] Field of Search ..... 407/32, 33, 40, 41, 407/47, 48, 49, 50, 109; 144/218, 230; 241/294

[56] References Cited

U.S. PATENT DOCUMENTS

| | | | |
|---|---|---|---|
| 1,137,216 | 4/1915 | Klingborg | 144/230 |
| 2,307,853 | 1/1943 | Palm | 407/33 |
| 2,652,749 | 9/1953 | Hagmeister | 407/49 |
| 3,694,880 | 10/1972 | Wolf | 407/47 |
| 3,725,988 | 4/1973 | Sunderman et al. | 407/40 |
| 3,987,525 | 10/1976 | Hasfjord | 407/49 |

*Primary Examiner*—Harrison L. Hinson
*Attorney, Agent, or Firm*—Morgan, Finnegan, Pine, Foley & Lee

[57] ABSTRACT

The invention relates to a cutting tool having a supporting body with a recess holding at least one striplike cutting element and an adjacent cavity intersecting the recess holding a deformable clamping body, a thrust piece and a tightening means. The tightening means applies pressure to the thrust piece which forces the deformable clamping body to fill the cavity and transmit pressure to the cutting element and clamp the same against a bearing wall in the body recess.

11 Claims, 3 Drawing Figures

CUTTING TOOL

The present invention relates to a cutting tool comprising a supporting body for at least one leaf or striplike cutting element. Although the present invention relates in particular to the design of so-called cutter blocks for the extrusion granulation of plastics and to the design of the associated spiders, the principle of the invention which will be discussed later can be applied also to other cutting tools such as milling tools.

If for instance plastics with a mineral filter are to be extrusion granulated, the cylindrical supporting body of the cutter block must be tipped with cutting strips of hard metal or ceramic material. The latter can by no means be fastened to the supporting body in the usual manner by soldering. Moreover, the soldering and exchanging of the cutting strips is an extremely time-consuming operation, and finally it precludes the use of stainless steel for the supporting body. Because of these difficulties, cutter blocks have been previously developed in which the cutting strips are fastened by clamping. For this purpose, the supporting body comprises one groove for each cutting strip extending approximately in the direction of the cylinder axis. The cutting strip bears against one wall of the said groove and is retained in this position by a strip-shaped clamping body likewise arranged in the groove.

The clamping body has a wedge-shaped cross-section and is tightened by means of radially extending screws which advance the clamping body towards the cutting strip.

It is a drawback of the known designs in which the cutting elements are secured by clamping that the clamping mechanism requires relatively much space so that only a relatively small number of cutting elements can be accommodated on a given length or given circumference, which fact directly influences the performance of the cutter block. Moreover, the relatively large interspaces between the cutting elements of the known high-speed cutter blocks lead to a high noise level, and finally they offer an acute risk of dirt settlements because the design of the known clamping means does not permit such interspaces to be optimally protected against the settlement of dirt.

Now, the present invention has for its object to provide a method for fastening leaf or striplike cutting elements to the supporting body of a cutting tool which on the one hand require less space as compared to the known clamping means and, on the other hand, enable the cutting tool areas on both sides of the cutting tools to be optimally adapted to the particular application. Starting from a known cutting tool comprising a supporting body for at least one leaf or striplike cutting element inserted into a recess of the said supporting body, and a clamping body arranged within a cavity provided in the said supporting body for securing the cutting element between one wall of the recess and the clamping body which can be tightened by means of a thread, this problem of the invention is solved in that the supporting body is provided with guide means for a rigid thrust piece that can be pressed against the clamping body by means of a thread that the clamping body is made at least in part from a plastic or elastomeric material and fills at least essentially the whole cavity in front of the thrust piece, and that the thrust piece engages a recess in the cutting element for positively securing the latter. Grace to the fact that in the arrangement of the invention the pressure can be exerted upon the clamping body from any desired direction for the purpose of displacing the plastic or elastomeric material towards the cutting element to clamp the latter, the areas of the supporting body in front of and behind the cutting element can be designed at wish and also in such manner that a cutter block in accordance with the invention will produce less noise and that no or at least less dirt will settle between the cutter elements, as compared to the known cutter blocks. Further, the supporting body may be made of any desired material, including in particular stainless steel, since the cutting elements need not be fastened by soldering. And finally, the fastening means of the invention can be designed to require less space—as will be described later—so that a cutter block of a given diameter will be able to accommodate a greater number of cutting elements than the cutter blocks of the known designs. When the rigid thrust piece is made to engage a recess in the cutting element, this offers the additional essential advantage that, contrary to the known cutting tools with clamped cutting elements, the latter are now positively secured so that even in the case of very high speeds there will be no risk that the cutting elements might come loose as a result of the developing centrifugal forces.

The clamping body need not necessarily be fully made of a plastic or elastomeric material. Rather, one can imagine that a small metallic plate or the like fastened to an elastomeric body may be used for ensuring the pressure transfer. And when the clamping body comprises also non-plastic or non-elastomeric parts, it need not necessarily fill the whole space of the cavity because the non-deformable parts of the clamping body may be used to prevent the plastic or elastomeric material from extending into empty areas of the cavity.

From German Pat. No. 1,809,775 an arrangement has been known in which the cutting element of a cutting tool is clamped within a recess of a cutting tool supporting body using a deformable pressure transfer medium. In this known design, two bores arranged at a right angle in relation to each other are provided within the supporting body. Each of the said bores encloses a piston, and the space between the pistons is filled with a plastic mass serving as pressure transfer medium. For the purpose of clamping the cutting element, one of the said pistons is advanced by means of a screw, while the other piston operates a two-armed lever which presses the cutting element against one wall of the recess in the supporting body. The screw advancing the one piston is arranged directly beside the cutting element so that this known cutting tool offers the same drawbacks as the before-described known arrangement for clamping a cutting tool. Another disadvantage of this arrangement must be seen in the fact that, inspite of its quite complex design, the cutting element is not positively secured.

In connection with the mounting of a handle or the like on a shaft it has also been known (U.S. Pat. No. 3,237,976) to use a screw for exerting pressure upon an elastomeric material arranged within a cavity, so that the elastomeric material will expand in transverse direction relative to the screw axis and bear against the periphery of the axis. However, in order to increase the safety of such mounting method, the shaft was provided with indentations over its circumference.

In the preferred embodiment of the cutting tool of the invention, the thrust piece guide means is arranged at least essentially in parallel to the side of the cutting element facing the cavity, because in this case the fastening means of the invention require the least space in vertical relation to the longitudinal extension of the cutting element. Moreover, such an arrangement of the thrust piece guide means enables the cutting element to be positively secured by the thrust piece even though the latter may not occupy a predetermined position along its guide means. In order to ensure that the cutting element is positively secured in any position of the thrust piece, the recess in the cutting element will be given the form of a groove extending in parallel relative to the thrust piece guide means which is always engaged by the thrust piece.

In view of the fact that silicon rubber is unaffected by temperature changes, this material is particularly well-suited as the elastomeric material of the clamping body.

In a preferred embodiment of the cutting tool of the invention, the cavity, the thrust piece guide means and the threaded bore take all the form of bores extending from one side of the supporting body towards its interior so that practically no space at all is needed in transverse relation to the cutting element. Moreover, one and the same bore may serve as cavity for the clamping body and thrust piece guide means, and under certain circumstances it could be well imagined that the threaded bore for the screw pressing the thrust piece against the clamping body could be designed as an extension of the thrust piece guide means.

Especially in the case of cutter blocks, the arrangement of the invention also offers the extremely advantageous possibility to provide a cover for all elements of the fastening means. The said cover may take the form of a flat ring fastened by countersunk screws to the supporting body of the cutter block so that dirt can nowhere settle and no noise-producing elevations or indentations will be left.

Further features, details and advantages of the invention will be obvious from the following description and the attached drawings showing a preferred embodiment of a cutting tool of the invention taking the form of a cutter block. In the drawings.

Figure 1:
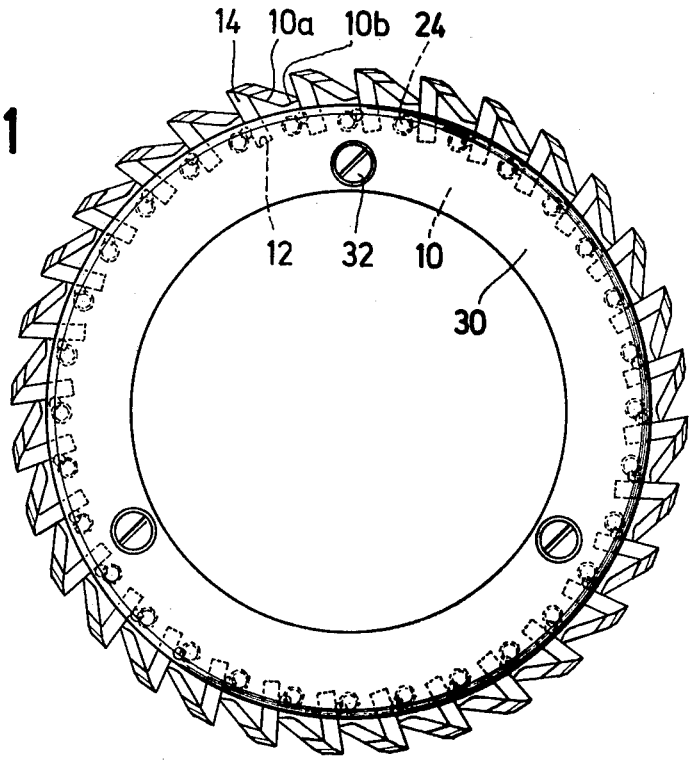
FIG. 1 is a face view of the cutter block.

The drawing shows an approximately circular supporting body 10 with grooves 12 for receiving cutting strips 14 arranged about its circumference. Moreover, the circumferential surface is of saw-tooth configuration so that each cutting strip is immediately followed by an inclined surface 10*a* continued without any interruption by a non-inclined surface area 10*b*.

Figure 3:
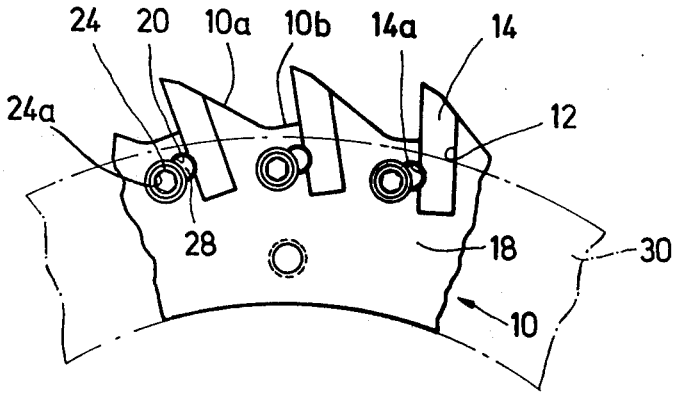
FIG. 3 is an enlarged section from FIG. 1, with the cover ring removed.
Figure 2:
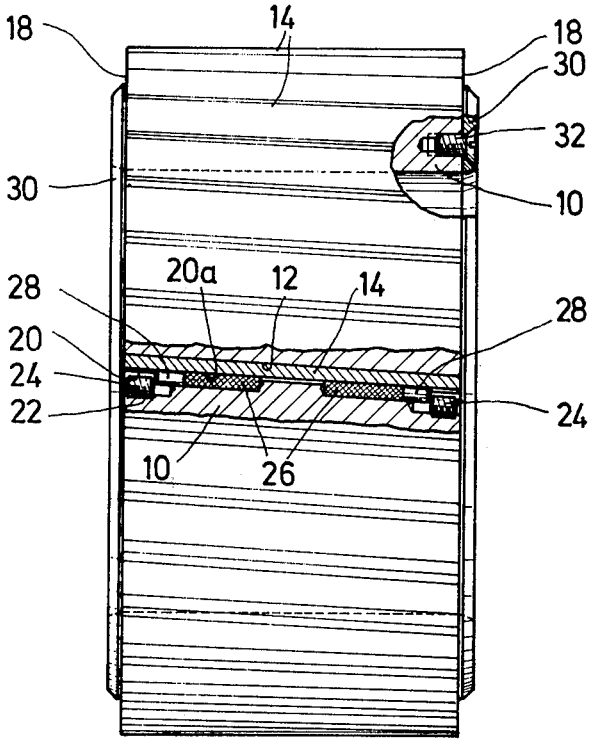
FIG. 2 is a side elevation of the cutter block, with certain parts brokwn away to give a better representation of the fastening means of the invention.

On the one side of each of the said receiving grooves 12, different bores extend from the faces 18 into the supporting body 10, parallel to the slightly inclined receiving grooves 12. These bores consist of a guide bore 20 overlapping the cross-section of the associated receiving groove 12 and a threaded bore 22 into which a set-screw 24 comprising a hexagonal recess 24*a* can be screwed. The guide bore 20 forms a cavity 20*a* delimited on its one side by the end of the guide bore, for receiving a cylindrical clamping body 26 made of a silicon rubber material, which is in operating contact with a cylindrical thrust piece 28 consisting of a metal material. Due to the fact that the threaded bore 22 is laterally offset against the guide bore 20, but with the cross-sections of the two bores overlapping, as can be clearly seen from FIG. 3, the thrust piece 28 can be pressed against the clamping body 26 by tightening the set-screw 24. Since the clamping body 26 fills the complete cavity 20*a* which is delimited on its one side by the end of the guide bore 20 and on its other side by the thrust piece 28, the pressure exerted by the thrust piece 28 upon the clamping body 26 displaces the elastomeric material of the clamping body towards the adjacent receiving groove 12 and/or the cutting strip 14 so that the latter is clamped between the elastomeric material and the wall of the receiving groove 12 facing away from the clamping body 26.

In addition, however, the fastening arrangement of the invention enables the cutting strips 14 to be positively secured in the radial direction of the cutter block. This is achieved by a longitudinal groove 14*a* provided on one side of the cutting strips for engagement with the two thrust pieces 28.

It results that in the arrangement of the invention the cutting strips are retained in position free from play and, in addition, positively secured in the radial direction.

In order to prevent the generation of noise by the bores and the settlement of dirt therein, cover rings 30 are fastened by screws 32 to both faces 18 of the supporting body 10.

Thus, the invention provides an arrangement for fastening the cutting strips which needs only extremely little space in the direction transvers to the direction of the cutters, and which further permits any desired configuration of the circumferential face of the cutter block, including a completely jointless design, so that a cutter block with a given diameter can be provided with a greater number of cutting strips than the cutter blocks of the known types, while on the other hand the material to be employed for the cutting strips and the supporting body can be selected without any regard whatever to the method of fastening the cutting strips.

The same basic fastening method may of course also be used for the spider coacting with the cutter block (also known as anvil cutter), so that only one single type of cutting strips will be necessary and the same fastening element can be used.

As an alternative to the embodiment shown, the thrust piece itself could take the form of a screw while its guide could take the form of a threaded bore. In this case, it would still be possible to use such a thrust piece screw for positively securing the cutting strips by bringing it partially into engagement with a recess in the cutting strip.

What we claim is:

1. A cutting tool comprising a supporting body and at least one striplike cuttng element, the supporting body comprising a recess for receiving the cutting element such that the cutting element abuts a bearing wall being provided by said recess, and disposed opposite said bearing wall, a clamping body comprising a deformable material, said clamping body being located in a cavity adjacent the cutting element for clamping the cutting element between said bearing wall and the clamping body, guide means for a rigid thrust piece closing said cavity and being disposed adjacent a recess in said cutting element, tightening means for pressing the thrust piece against said clamping body which fills said cavity such that when the tightening means is actuated said thrust piece engages said recess of the cutting element and the deformable material of said clamping body transmits the pressure exerted by the thrust piece to the cutting element thereby clamping the cutting element between the clamping body and said bearing wall.

2. A cutting tool in accordance with claim 1, wherein the guide means for the thrust piece extends in parallel to the side of the cutting element facing the cavity.

3. A cutting tool in accordance with claim 1, wherein the supporting body is provided with a threaded bore extending in parallel to the thrust piece guide means for receiving a set-screw that can be tightened against the thrust piece.

4. A cutting tool in accordance with claim 1, wherein the clamping body is of oblong shape.

5. A cutting tool in accordance with claim 1, wherein the deformable material of the clamping body is silicon rubber.

6. A cutting tool in accordance with claim 1, wherein the cavity, the thrust piece guide means and the threaded bore take the form of bores extending from one side of the supporting body towards its interior.

7. A cutting tool in accordance with claim 1, wherein one single bore forms both the cavity and the thrust piece guide means.

8. A cutting tool in accordance with claim 2, wherein the recess in the cutting element takes the form of a groove extending in parallel to the thrust piece guide means.

9. A cutting tool in accordance with claim 3, wherein the threaded bore is laterally displaced in relation to the thrust piece guide means.

10. A cutting tool in accordance wth claim 6, wherein a cover is provided for the bores.

11. A cutting tool in accordance with claim 1, wherein the clamping body comprises a substantially incompressible deformable material.

* * * * *